US007811180B2

(12) United States Patent
Roach et al.

(10) Patent No.: US 7,811,180 B2
(45) **Date of Patent: *Oct. 12, 2010**

(54) MULTI-METAL GOLF CLUBS

(75) Inventors: Ryan L. Roach, Carlsbad, CA (US); Scott A. Rice, San Diego, CA (US)

(73) Assignee: Cobra Golf, Inc., Carlsbad, CA (US)

( * ) Notice: Subject to any disclaimer, the term of this patent is extended or adjusted under 35 U.S.C. 154(b) by 812 days.

This patent is subject to a terminal disclaimer.

(21) Appl. No.: 11/534,724

(22) Filed: Sep. 25, 2006

(65) Prior Publication Data

US 2008/0076597 A1 Mar. 27, 2008

(51) Int. Cl.
*A63B 53/04* (2006.01)

(52) U.S. Cl. ..... 473/342; 473/349; 473/350

(58) Field of Classification Search ..... 473/324–350, 473/287–292

See application file for complete search history.

(56) References Cited

U.S. PATENT DOCUMENTS

| | | | | |
|---|---|---|---|---|
| 3,983,014 | A | 9/1976 | Newman et al. | |
| 4,573,685 | A * | 3/1986 | Young et al. | 473/250 |
| 4,884,812 | A | 12/1989 | Nagasaki et al. | |
| 5,303,922 | A | 4/1994 | Lo | |
| 5,358,249 | A * | 10/1994 | Mendralla | 473/331 |
| 5,405,136 | A * | 4/1995 | Hardman | 473/342 |
| 5,425,535 | A | 6/1995 | Gee | |
| 5,439,712 | A | 8/1995 | Hattori et al. | |
| 5,489,094 | A * | 2/1996 | Pritchett | 473/342 |
| 5,509,660 | A * | 4/1996 | Elmer | 473/288 |
| 5,616,088 | A | 4/1997 | Aizawa et al. | |
| 5,669,829 | A | 9/1997 | Lin | |
| 5,713,800 | A | 2/1998 | Su | |
| 5,833,551 | A | 11/1998 | Vincent et al. | |
| 6,200,228 | B1 | 3/2001 | Takeda | |
| 6,238,302 | B1 | 5/2001 | Helmstetter et al. | |
| 6,410,197 | B1 | 6/2002 | Bellino et al. | |
| 6,443,853 | B1 | 9/2002 | Bouquet | |
| 6,443,854 | B1 | 9/2002 | Calboreanu | |

(Continued)

OTHER PUBLICATIONS

"Coating and Surface Treatment," Furukawa-Sky Aluminum Corp., www.furukawa-sky.co.jp/english/produce/en_coating.htm.

(Continued)

*Primary Examiner*—Sebastiano Passaniti
(74) *Attorney, Agent, or Firm*—Knobbe, Martens, Olson & Bear, LLP

(57) ABSTRACT

A composite material golf club head is provided having a body made from a first metal and a face insert press fitted to a portion of the body and made from a second metal. The metals are chosen so that the first metal is heavier than the second metal. The second metal is disposed towards the front and top of the body, and is preferably hard-anodized. In addition, an interlocking structure, for example rectangular or dove tail shaped channels, is provided in the body so that the face insert becomes embedded in the interlocking structure to anchor the face insert to the body. Portions of the golf club head, such as the face insert or sole plate, are anodized to protect against corrosion. The anodized coating is colored to improve aesthetic characteristics or infused with a polymer to increase or reduce friction.

26 Claims, 8 Drawing Sheets

U.S. PATENT DOCUMENTS

| | | | | |
|---|---|---|---|---|
| 6,648,773 | B1 | 11/2003 | Evans | |
| 6,679,786 | B2 | 1/2004 | McCabe | |
| 6,739,983 | B2 | 5/2004 | Helmstetter et al. | |
| 6,893,358 | B2 | 5/2005 | Dewanjee et al. | |
| 6,966,846 | B2 * | 11/2005 | Bloom, Jr. | 473/292 |
| 6,971,960 | B2 | 12/2005 | Dewanjee et al. | |
| 6,986,715 | B2 | 1/2006 | Mahaffey | |
| 7,048,648 | B2 | 5/2006 | Breier et al. | |
| 7,060,176 | B2 | 6/2006 | Rasmussen | |
| 7,160,204 | B2 | 1/2007 | Huang | |
| 7,232,380 | B2 | 6/2007 | Nakahara | |
| 7,261,644 | B2 * | 8/2007 | Burrows | 473/340 |
| 7,364,513 | B2 * | 4/2008 | Krumme | 473/329 |
| 2002/0193176 | A1 * | 12/2002 | Grace | 473/341 |
| 2004/0058747 | A1 | 3/2004 | Clausen et al. | |
| 2004/0235584 | A1 | 11/2004 | Chao et al. | |
| 2005/0239576 | A1 | 10/2005 | Stites et al. | |
| 2006/0025235 | A1 | 2/2006 | Nakahara et al. | |
| 2006/0084527 | A1 | 4/2006 | Nycum et al. | |

OTHER PUBLICATIONS

"Sanford Hardlube," Duralectra, www.duralectra.com/af/sh.asp.

"Hard Anodizing Finish Specification," Engineers Edge, www.engineersedge.com/mil_a_8625.htm.

"The Corrosion of 6061-T6 Aluminum by a Polyurethane-Sealed Anodized Coat," M.D. Danford, Materials and Processes Laboratory Science and Engineering Directorate, NASA Technical Memorandum 100394.

"About Anodizing," Alpha Metal Finishing Co., www.alphametal.com/anodizing.htm.

"Tiodize Process," Tiodize Company, http://www.tiodize.com/tiodizebrochure.pdf#search=%22titanium%20design%20considerations%20tiodize%20processes%22.

"Anodizing, What Is It?" AAC Web Forum, www.anodizing.org/definitions.html.

Office Action, Nov. 30, 2009, U.S. Appl. No. 11/960,809.

* cited by examiner

MULTI-METAL GOLF CLUBS

FIELD OF THE INVENTION

The present invention relates to golf clubs, and more specifically to multi-metal golf clubs.

BACKGROUND OF THE INVENTION

Perimeter weighting in a golf club distributes the mass of the club toward the perimeter, minimizing the effects of off-center hits on the face of the golf club away from the sweet spot and producing more accurate and consistent golf ball trajectories. Perimeter weighting is achieved by creating a cavity in the back of the golf club opposite the face or hitting surface. The material weight saved by creating this cavity is redistributed around the perimeter of the golf club head. In general, larger cavity volumes correspond to increased amounts of mass distributed around the perimeter. Additionally, more of the perimeter weight is moved to the sole of the club to move the center of gravity downward and rearward.

Alternative approaches for moving the center of gravity of a golf club head rearward and downward in the club head utilize composite structures. These composite structures utilize two, three, or more materials that have different physical properties including different densities. By positioning materials that provide the desired strength characteristics with less weight near the crown or top line of a golf club head, a larger percentage of the overall weight of the golf club head is shifted towards the sole of the club head. This results in the center of gravity being moved downward and rearward. This approach is advantageously applicable to muscle back iron clubs or fairway woods, as this will help to generate loft and power behind and below the ball. However, composite materials must be bonded together, for example by welding, swaging, or using bonding agents such as epoxy, and may be subject to delamination or corrosion over time. This component delamination or corrosion results in decreased performance in the golf club head and can lead to club head failure.

Therefore, there remains a need for a composite golf club head that utilizes components having different densities designed in such a way as to minimize the problems associated with delamination, corrosion, or separation of the components.

SUMMARY OF THE INVENTION

The present invention is directed to golf club heads constructed from composite materials. The golf club head includes a body portion, for example a cast or forged body portion, made from a first metal to which is attached a face insert made from a second metal. The first and second metals are selected so that the first metal has a higher density than the second metal. An example of suitable metals includes titanium or steel for the first metal and aluminum for the second metal. The face insert is positioned on the front of the body portion adjacent the top line (or crown) and forms at least a portion of the hitting surface of the club head. In order to minimize delamination or separation between the body and the face insert, an interlocking structure is preferably formed in the body portion and arranged to interlock with the face insert when the face insert is fitted onto the body portion. This interlocking structure includes one or more channels running through the top section of the body portion to which the face insert is attached. Upon attachment, the face insert is interlocked with the channels, providing sufficient and stable attachment between the face insert and the body portion. The channel is shaped to further enhance the connection between the two components. These shapes include, but are not limited to, rectangular cross sections and cross sections having overhangs such as dove tail cross-sections.

The present invention is also directed at anodizing at least one part of the golf club head, preferably the face insert. In an alternative embodiment, all the components of the club head are anodized. The face insert, the body of the club head or both can be anodized. For example, the face insert can be made from an anodized aluminum, or the body portion can be made from anodized titanium, or both. A polymer such as PTFE, polyurethane or polyurea can be added to the anodized layer to enhance the performance of the clubs.

DETAILED DESCRIPTION

Figure 1:
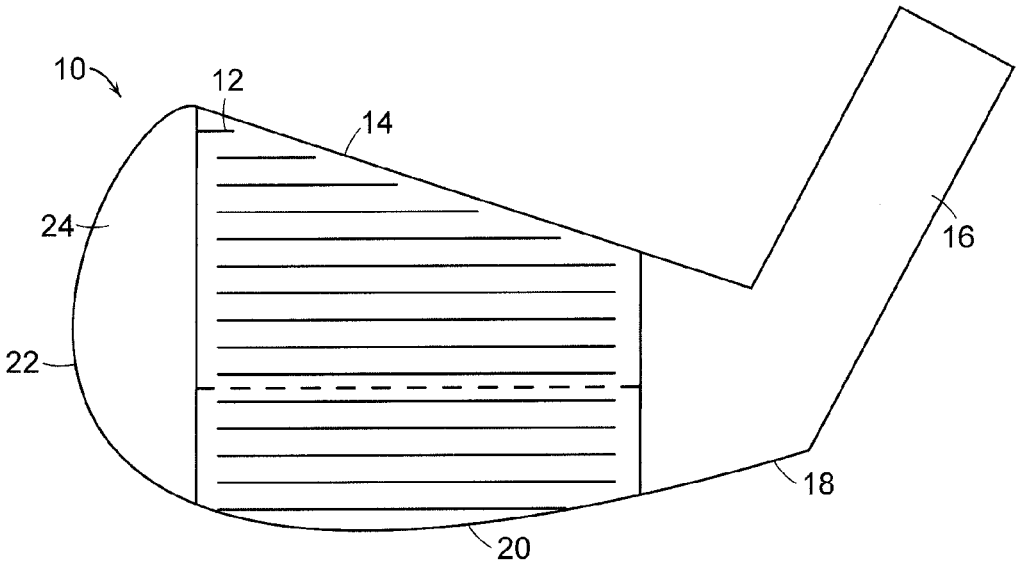
FIG. 1 is a front view of an embodiment of a golf club head in accordance with the present invention.
Figure 2:
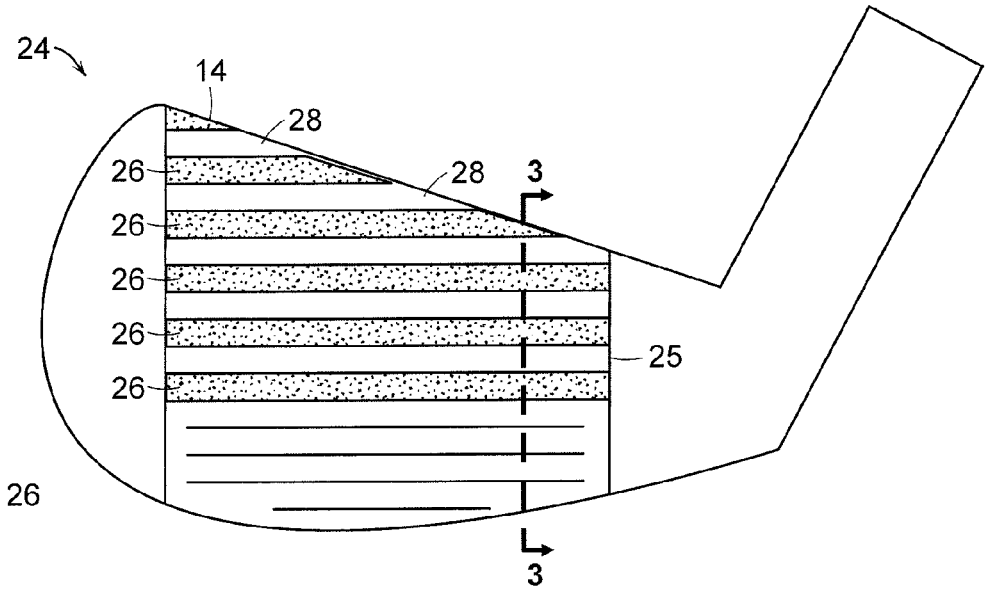
FIG. 2 is a front view of an embodiment of a body portion without the face insert of the present invention.
Figure 4:
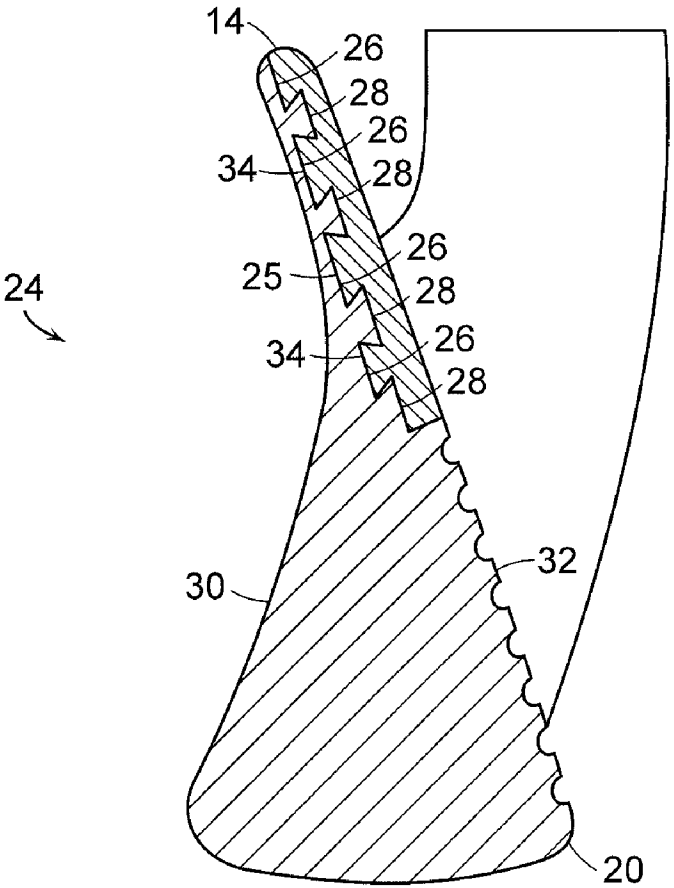
FIG. 4 is a cross-section view of the body portion showing another embodiment of the interlocking structure of the present invention.

Referring now to the accompanying FIGS. 1-7, exemplary embodiments of the golf club head 10 in accordance with the present invention include face insert 12 and body portion 24, which is attached to hosel 16. Hosel 16 is adapted to receive a shaft (not shown). Club head 10 is preferably cast or forged from suitable material such as stainless steel, carbon steel, or titanium. In one embodiment, body portion 24 is a cast body portion. Body portion 24 includes crown or top line 14, toe 22, sole 20 and heel 18 that form the perimeter of body portion 24. Hosel 16 extends generally from heel 18 of body portion 24. In one embodiment, club head 10 is arranged as muscle-back iron-type club head that has a thicker bottom back portion. Body portion 24 also includes front 32 forming the hitting surface.

Improvement in the location of the center of gravity of golf club heads in accordance with the present invention is achieved through the use of a composite construction that utilizes various materials having varying weights or densities. In particular, golf club head 10 utilizes two materials. Body portion 24 is constructed of a first material, for example a first metal, having a first weight or density. Suitable materials for the body portion 24 include, but are not limited to, stainless steel, carbon steel, beryllium copper, titanium and metal matrix composites (MMC). Preferably, body portion 24 is made from a higher density metal such as stainless steel or titanium. Club head 10 also includes face insert 12 attached to front 32 of body portion 24. Face insert 12 is constructed of a second material, i.e. a second metal having a second density. Suitable materials for face insert 12 include titanium, aluminum and alloys thereof. In one embodiment, the first weight or the first density is greater than the second weight or second density.

In order to move the center of gravity of club head 10 downward and to the rear, lightweight face insert 12 is attached to body portion 24 so that face insert 12 is disposed on front 32 of body portion 24 adjacent crown or top line 14. Therefore, face insert 12 forms a part of the club face or hitting surface of club head 10. To minimize delamination of face insert 12 from body portion 24, body portion 24 includes interlocking structure 25 formed on at least a portion of front 32 of body portion 24 adjacent top line 14. When face insert 12 is attached to or press fit on front 32 of body portion 24, face insert 12 is secured and anchored in interlocking structure 25. Optionally, adhesives, welds or other bonding agents can be used to help secure face insert 12 into interlocking structure 25. The interaction and meshing of face insert 12 with interlocking structure 25 is sufficient to fixedly secure face insert 12 to body portion 24.

In one embodiment, interlocking structure 25 contains at least one channel 26 running through a top of front 32 of body portion 24. Alternatively, a plurality of parallel channels 26 are formed in front 32 of body portion 24, further defining a plurality of associated ridges or raised portions 28. In one embodiment, the plurality of parallel channels 26 are arranged substantially parallel to top line 14 or sole 20 of body portion 24. In one embodiment, face insert 12 is pressed onto body portion 24, such that the second metal of face insert 12 substantially fills each channel 26 when face insert 12 is attached to body portion 24. Although channel 26 can be arranged as any shape including curves and annular shapes, preferably, channel 26 is a generally rectilinear line arranged parallel to sole 20.

Figure 3:
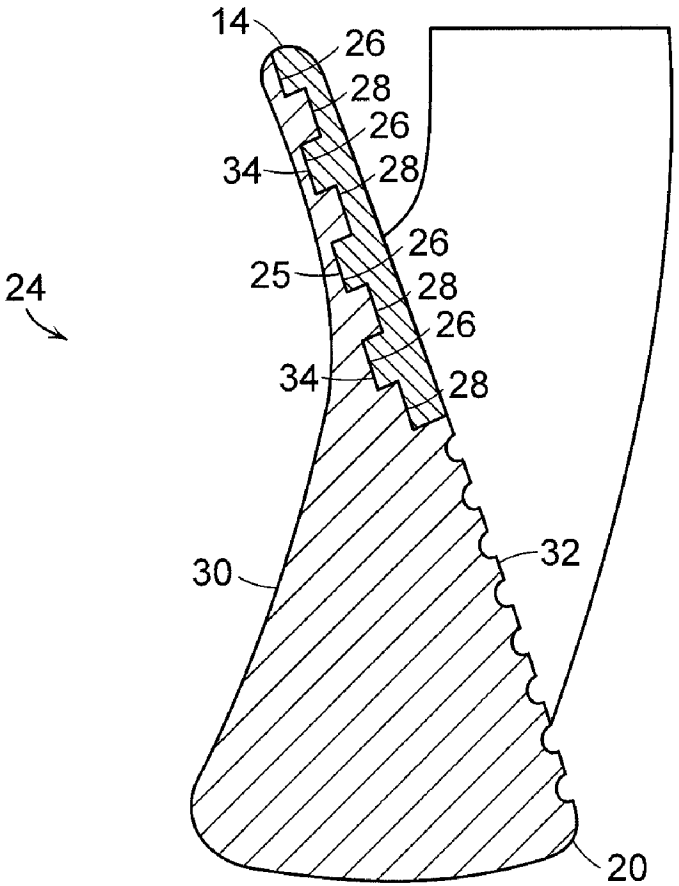
FIG. 3 is a view through line 3-3 of FIG. 2.
Figure 6:
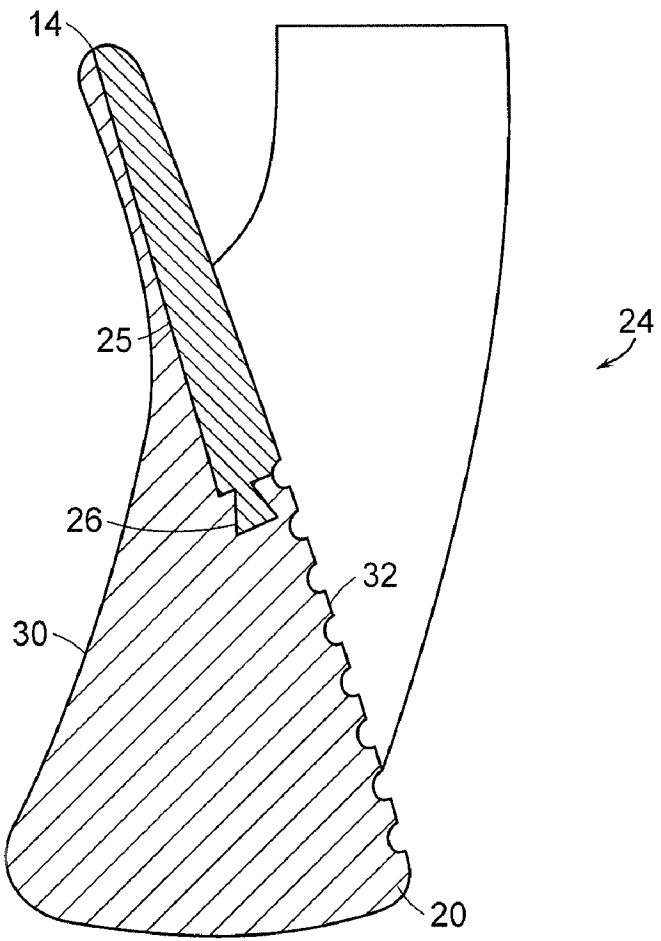
FIG. 6 is a cross-section of the body portion showing another embodiment of the interlocking structure of the present invention.
Figure 5:
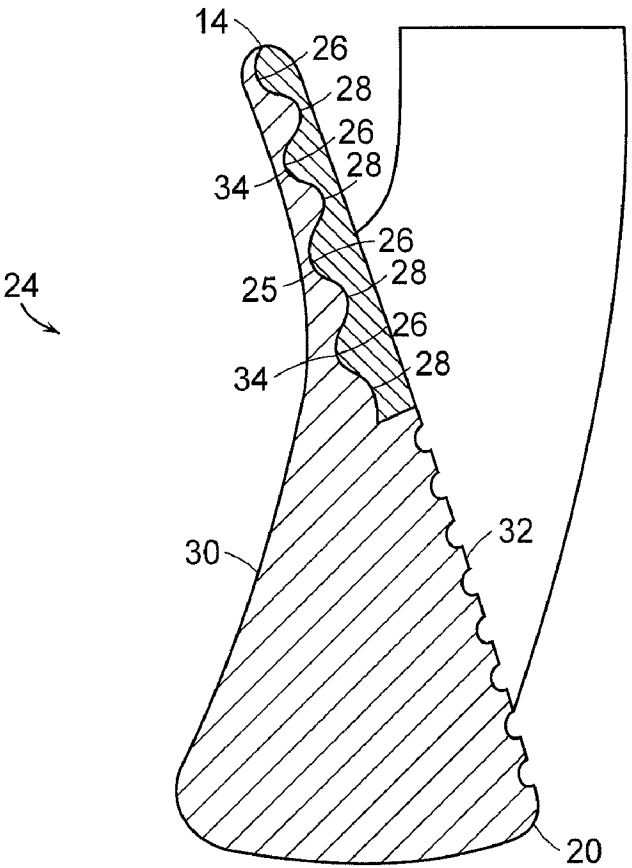
FIG. 5 is a cross-section of the body portion showing another embodiment of the interlocking structure of the present invention.

By embedding face insert 12 in interlocking member 25 having channel 26, a stronger more resilient bond is formed between face insert 12 and body portion 24. Depending on the shape, and in particular the profile in cross section, of the channel, both increased surface area contact and increased mechanical binding is achieved between body portion 24 and face insert 12 when press fit together. In one embodiment as illustrated in FIG. 3, each channel has a generally rectangular cross section. In another embodiment, at least one and preferably two undercuts 34 (FIG. 4) are provided in each channel. Undercut 34 is formed by making channel 26 narrow as it approaches its open end. In one embodiment, channel 26 has a dove tail shaped cross section. Alternatively, channel 26 has a generally rounded cross section (FIG. 5), for example circular or oval. Also ridge portion 28 can be rounded or curved outward to facilitate easier engagement between face insert 12 and body portion 24 when the two components are press fit together. Although in these embodiments, each channel 26 opens toward front 32 of body portion 24, other arrangements are also possible. For example, as illustrated in FIG. 6, channel 26 can open towards crown or top line 14 of body portion 24. Preferably, channel 26 has a dove tail shaped cross section in this embodiment. Face insert 26 will become embedded in this upwardly opening channel when attached to body portion 24, preferably with adhesives.

Figure 7:
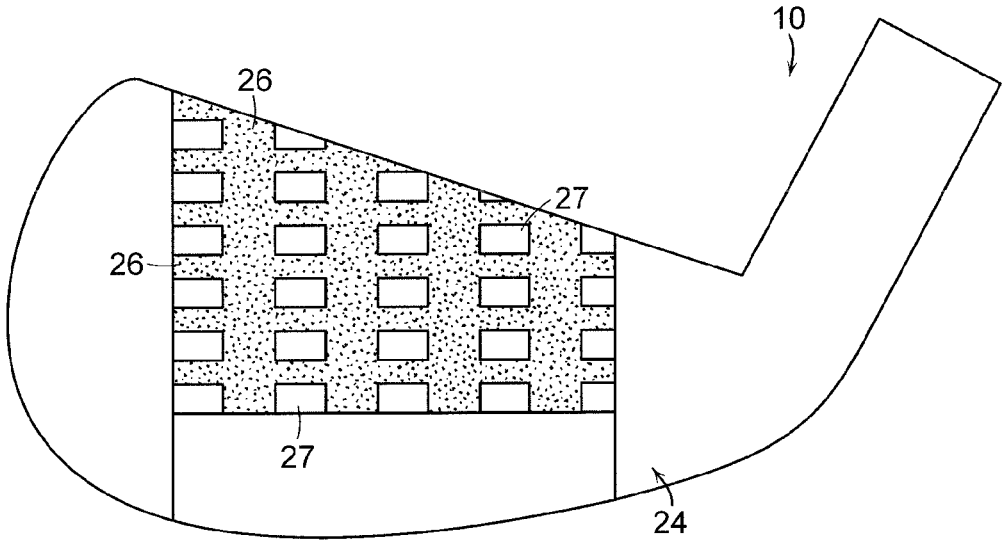
FIG. 7 is another embodiment of FIG. 2.

In another embodiment, interlocking member 25 comprises a plurality of upstanding posts 27 formed by intersecting channels 26, e.g., one set of horizontal channels 26 and another set of vertical channels 26 as shown in FIG. 7. Face insert 12 can be hammered or pressed onto body portion 24, for example by swaging or cold-forging. This method can also be used with the embodiments shown in FIGS. 4 and 5.

In one embodiment, in order to form the interlocking structure on the front of the body portion, at least one channel is formed that runs through the portion of the front of the case body. Alternatively, a plurality of parallel channels is formed in the front of the body such that each channel is parallel to at least one of the top lines or the sole of the body portion. The channel can be formed to have a generally rectangular cross section. Alternatively, the channel is formed to have a dove tail shaped cross section. Having formed the interlocking structure in the front of the body, the face insert is pressed onto the front of the cast body to secure a portion of the face insert in the interlocking structure.

Exemplary embodiments in accordance with the present invention include a method for making a golf club head by forming an interlocking structure on at least a portion of the front of the body portion of golf club head adjacent a top line thereof. As was described above, the body includes the top line, sole, toe, heel, front and back opposite the front opposite, and the body is made from a first metal. A face insert is attached to the front of the cast body by securing a portion of the face insert in the interlocking structure of the body. The face insert is constructed of a second metal. The first and second metals are selected such that the first metal has a greater density or weight than the second metal. For example, the first metal is selected to be titanium or a titanium alloy, and the second metal is selected to be aluminum or an aluminum alloy. The face insert 12 can occupy between 10% and 40% of the volume of the club head.

Low-density, high-strength alloys such as those made from aluminum are particularly suitable for the present invention. The following table illustrates the masses and thickness of corresponding typical face inserts for iron-type golf clubs:

| Face Insert Material | Typical Face Insert Thickness | Approx. Mass of Face Insert |
|---|---|---|
| High Strength Steel | 0.090 in. | 50 g |
| Titanium | 0.120 in. | 40 g |
| High Strength Aluminum | 0.140 in. | 30 g |

The differences in the thickness of the face inserts for the different materials are necessary due to the varying material strengths; these face inserts have substantially similar strengths. Of the three materials, steel is the strongest, and thus can have the thinnest face, but it has a higher density than both aluminum and titanium. Consequently, even a thinner steel face has a mass greater than either of the titanium or high-strength aluminum faces. Furthermore, the high-strength aluminum face insert's low density allows more mass to be redistributed for an improved center of gravity location and size of the sweet spot.

When a low-density metal such as a high-strength aluminum alloy is used for a face insert, it should be an alloy with suitable material strength and mechanical properties such as yield strength, tensile strength, hardness, elongation, etc., to avoid club failure or performance deterioration. Preferably, a high-strength aluminum alloy such as an alloy containing Scandium and 7-series high strength aluminum alloy ("Sc-7") or an aluminum alloy containing a percentage of ceramic ("M5C") is used. Material properties for these alloys, as well as suitable alloys MMC-7 and 13A, are listed in the table below.

| | Alloy: | | | |
|---|---|---|---|---|
| | MMC-7 | Sc-7 | 13A | M5C |
| Al Series: | 7xxx | 7xxx | 6xxx | 5xxx |
| Chem Composition: | Al—1.5Mg—4.0Zn + 6SiC | Al—1.5Mg—4.0Zn + Sc | Al—0.9Mg + Sc | Al—5.0Mg + ceramic (approx 0.8%) |
| Hardness: | 56 HRB | 81 HRB | 80 HRB | 65 HRB |
| Tensile Strength: | 49 ksi | 70 ksi | 62 ksi | 51 ksi |
| Yield Strength: | 45 ksi | 62 ksi | 54 ksi | 37 ksi |
| Elongation: | 11% | 10% | 11% | 14% |
| Face thickness preferred: | 3.2 mm (0.1260 in.) | 3.2 mm (0.1260 in.) | 3.2 mm (0.1260 in.) | 3.5 mm (0.1378 in.) |

However, aluminum alloys, including high-strength aluminum alloys such as Sc-7 and M5C, can be susceptible to corrosion, and in some cases more than traditional stainless steel or titanium materials. When aluminum alloys are in contact with steel alloys, galvanic corrosion can also adversely affect the aluminum.

In accordance with an embodiment of the present invention, the metals of the inventive golf club are oxidized, more preferably anodized, to improve its strength and corrosion resistance. Oxidation of many untreated metals such as aluminum occurs naturally as the metal undergoes prolonged contact with air. Anodization is a process used to modify the surface of a metal, and it produces a much more uniform, more dense, and harder oxidation layer than what is formed by natural oxidation. It can be used to protect the metal from abrasion or corrosion, create a different surface topography, alter the crystal structure, or even color the metal surface. During anodization, a chemical reaction occurs, producing an oxide layer bonded to the surface of the metal. For example, to anodize an aluminum or aluminum alloy object, the object is first pre-treated by an ordinary degreasing. Then the surface is freed of scratches or existing oxides, preferably by an etching process. The object is submerged in a chromic acid or more preferably a sulfuric acid solution. Next, an aluminum oxide layer is made on the object by passing a DC current through the chromic acid or sulfuric acid solution, with the aluminum object serving as the anode. The current releases hydrogen at the cathode and oxygen at the surface of the aluminum anode, creating a buildup of aluminum oxide. Anodizing at 12 volts DC, a piece of aluminum with an area of about 15.5 square inches can consume roughly 1 ampere of current. In commercial applications the voltage used is usually in the range of about 15 to 21 volts. Conditions such as acid concentration, solution temperature and current are controlled to allow the formation of a consistent oxide layer, which can be many times thicker than would otherwise be formed. This oxide layer increases both the hardness and the corrosion resistance of the aluminum surface. The oxide forms as microscopic hexagonal "pipe" crystals of corundum, each having a central hexagonal pore, which is also the reason that an anodized part can take on color in the dyeing process. Following the formation of a satisfactory oxide coating, the anodized object is often sealed to maximize the degree of abrasion resistance. Sealing can be accomplished by immersing the object in a sealing medium, such as a 5% aqueous solution of sodium or potassium chromate (pH 5.0 to 6.0) for 15 minutes at a temperature from about 90° C. to 100° C., boiling de-ionized water, cobalt or nickel acetate, or other suitable chemical solutions.

Different types of anodizing, Type I, II, and III, are explained in MIL-Spec MIL-A-8625F (Anodic Coatings for Aluminum and Aluminum Alloys), which is hereby incorporated by reference. Most preferably, the face insert is hard-anodized with a Type III coating according to MIL-A-8625F. This hard anodic coating is thicker than standard Type I or Type II anodic coatings by up to 0.0035 inches, and penetrates deeper within the coated metal than standard Type I or Type II anodic coatings. The following table from MIL-A-8625F shows the common thickness ranges among the types of anodic coatings.

| Coating Type | Thickness Range (Inches) |
|---|---|
| Type I, IB, IC, IIB | 0.00002 to 0.0007 |
| Type II | 0.00007 to 0.0010 |
| Type III | 0.0005 to 0.0045 |

Commercial examples of Type III-compliant anodizing processes include the Sanford Hardcoat® process by Duralectra of Natick, Mass. and hardcoat anodizing done by Alpha Metal Finishing Co. of Dexter, Mich., both of which are hereby incorporated by reference. The Type III hard-anodizing process is similar to Type I and II processes, but Type III uses a sulfuric acid bath at a lower temperature, approaching 0° C., as well higher currents. In accordance with MIL-A-8625F, Type III coatings are generally not applied to aluminum alloys having a nominal copper content in excess of 5% or nominal silicon content in excess of 8%. Alloys which have a porosity of greater than about 5% less preferred for Type III coatings. In addition, Because Type III coatings have increased abrasion resistance, sealing or infusing the coating with a polymer in the same manner as Type I and II, as discussed in more detail below, is not required, and the coating can remain somewhat porous. Furthermore, having a porous unsealed structure allows the hard-anodic coating to be infused with a colored dye to change the appearance of the object, or a polymer such as polytetrafluoroethylene (PTFE) or a polyepoxide (epoxy) or polyurethane-based resin to adjust the frictional characteristics of the object.

A method for infusing a hard-anodic coating with a polymer is disclosed in U.S. Pat. No. 5,439,712 to Hattori et al. entitled "Method for Making a Composite Aluminum Article," the entirety of which is hereby incorporated by reference. Once the hard-anodization process is complete, the anodized object is immersed in an infusion solution. This infusion solution contains positively-charged polymer particles dispersed into the solution using a nonionic active agent. The solution and the aluminum object are heated to a temperature ranging from 40° C. to 80° C., and a voltage of 2 to 10 volts is applied. The aluminum object acts as an anode, and the positively-charged polymer particles become absorbed into the hard anodic coating to form a uniform monomolecular layer. As can be appreciated by those skilled in the art, any positively-charged polymer particles can be used, and depending upon the type of alloy or polymer that is used, the temperature and voltage may vary.

Figure 8:
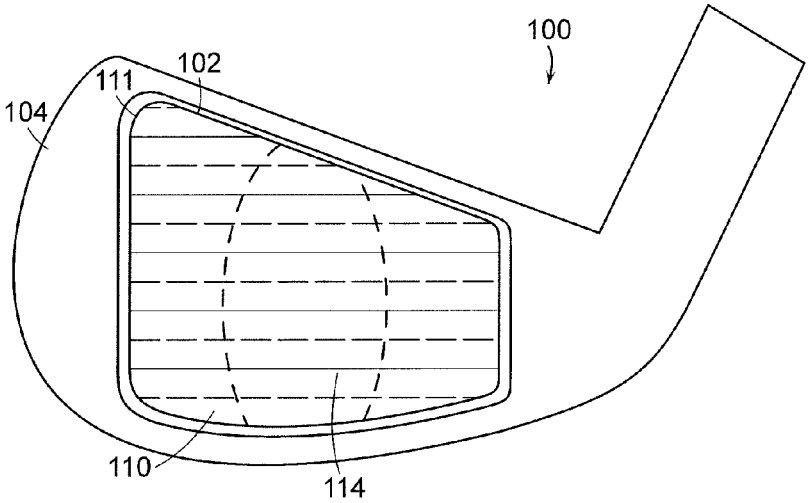
FIG. 8 is a front view of an embodiment of a club head of the present invention.
Figure 9:
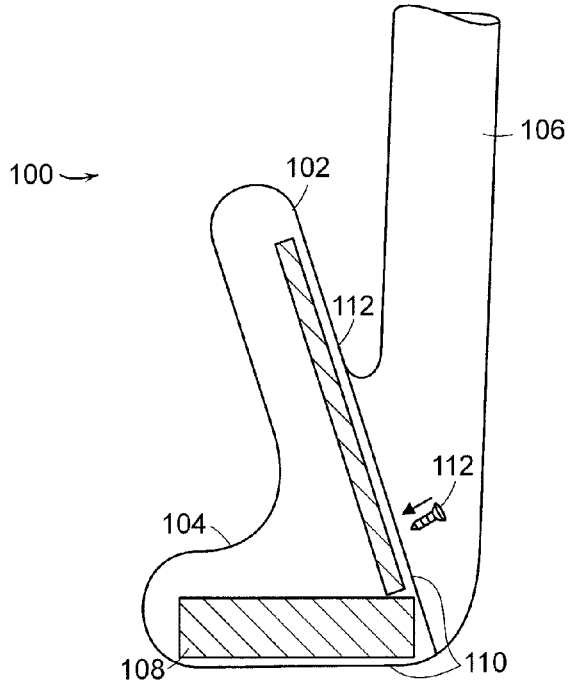
FIG. 9 is a cross-sectional view of an embodiment of a club head of the present invention.
Figure 9B:
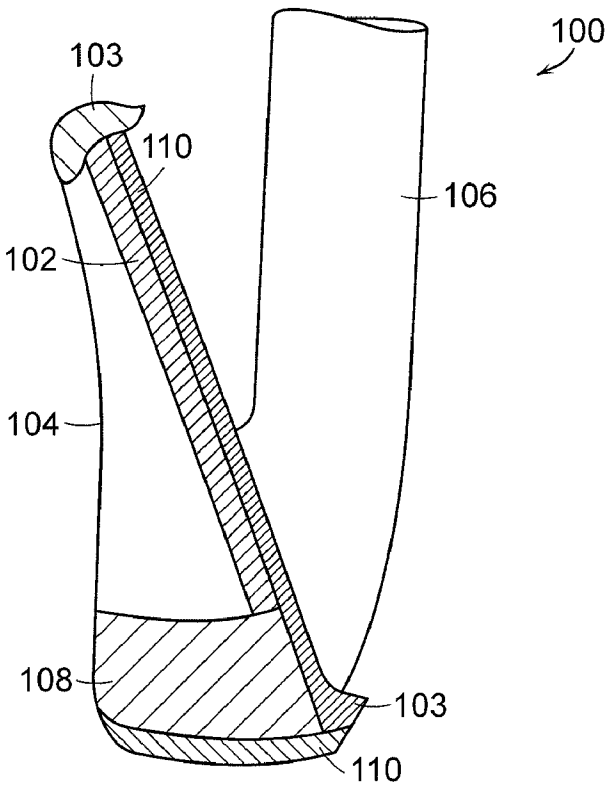
FIG. 9*b* is a cross-sectional view of another embodiment of a club head of the present invention.

FIGS. 8 and 9 show an embodiment of the present invention, with face insert 102 attached to body 104 of club head 100. Face insert 102 is preferably hard-anodized, i.e., Type III, before attachment so that it is coated with hard-anodic coating 110. After the face insert is hard-anodized, it is preferably attached to the body of the club head via a resin 111 such as epoxy or urethane, with the perimeter of face insert 102 supported on the reverse side by a ledge (not shown) that is part of club head body 104. However, various other methods of attachment may be envisioned by those skilled in the art, including the attachment methods mentioned in previous embodiments. Other methods of attachment include, but are not limited to, using screws 112 as shown in FIG. 9, or cold-forging or swaging a portion 103 of body 104 over face insert 102 shown in FIG. 9*b* to retain face 102. Insert 102 may have a thin ledge around its periphery sized and dimensioned to receive portion 103, so that the hitting face is flat. In addition, it may be advantageous to drill larger than normal holes in face insert 102 for screws 112, as coating 110 will fill in some of the area during the anodizing process, or else use smaller sized screws.

Although hard-anodic coatings are often uncolored, gray, or clear, the face insert may be hard-anodized with a colored or dyed coating to create an improved aesthetic effect. The Sanford Hardcoat® process by Duralectra mentioned above has the capability of applying a hard-anodic coat with color to aluminum. Coloring can also be accomplished through a two-step electrolytic method, an integral coloring process which combines anodizing and coloring, organic or inorganic dyeing through polymer infusion as mentioned above, interference coloring, etc. Such a colored coating could be used to effectively outline or shade a hitting area or "sweet spot" on the club head. Sweet spot 114 in FIG. 8 is an example of such a colored region on the face insert. Coloring only a portion of an object can be done by masking the parts of the object that are not to be anodized with a protective coating mask. Such a coating or masking is often made from vinyl or other polymers and is usually made to be easily applied and removed. A commercially available peelable mask appropriate for hard-anodizing procedures is the PlateOff Mask 4210, available from General Chemical Corp. of Detroit, Mich.

Figure 9A:
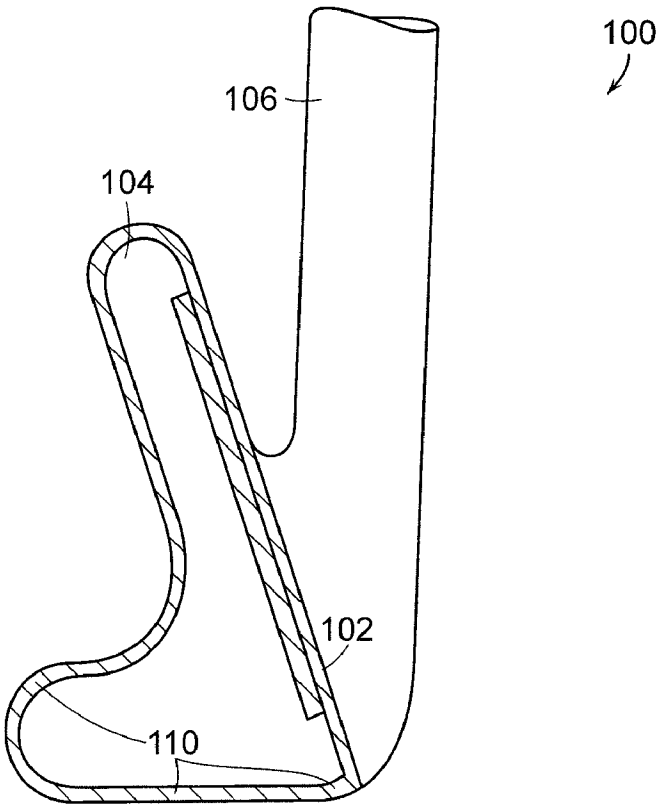
FIG. 9*a* is a cross-sectional view of another embodiment of a club head of the present invention.

The present invention is not limited to examples wherein only the face insert is hard-anodized. Although face insert 102 is preferably constructed from a lighter, less dense material than club head body 104, it is possible to attach the face insert to club head body 104 prior to the anodization process. As shown in FIG. 9*a*, once face insert 102 is attached, then the entire club head 100, including body 104 and face insert 102, may be substantially coated by hard-anodic coating 110. This is especially preferable when face insert 102 is made from aluminum or aluminum alloy, and when club head body 104 is made from titanium or titanium alloy, as these materials may easily be anodized. Whereas aluminum is anodized according to MIL-A-8625F, titanium is anodized according to AMS-2488 or MIS-23545, both of which are hereby incorporated by reference. The Tiodize® Company of Huntington Beach, Calif. processes titanium and titanium alloys according to these specifications under the name of the Tiodize® Processes, all of which are hereby incorporated by reference. The Tiodize® Company produces a brochure titled "Tiodize Process" explaining their processes, which is also hereby incorporated by reference. Titanium is generally anodized in a similar manner as aluminum, by immersing a titanium object in a solution and running an electric current through the solution. However, titanium is typically immersed in an alkaline solution at room temperature, unlike aluminum and its alloys. Although the processes for anodization of aluminum and titanium are not the same, masking may be done during the counterpart anodizing process to avoid interference between the coatings or metals. This embodiment also provides club designers with a wider range of options for attachment methods than if face insert 102 is hard-anodized prior to attachment to club head body 104 to minimize any possible damage to the hard-anodic coating 110 during the attachment process when body 104 and insert 102 have been connected prior to anodization.

Figure 11:
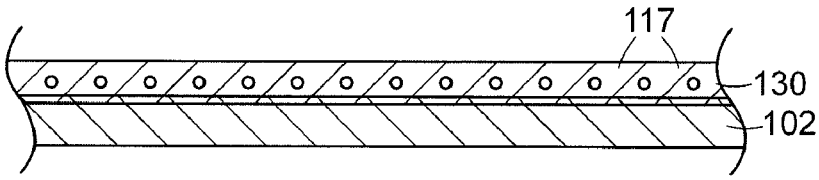
FIG. 11 is a cross-sectional view of an infused hard-anodic coating applied to a face insert according to the present invention.
Figure 12:
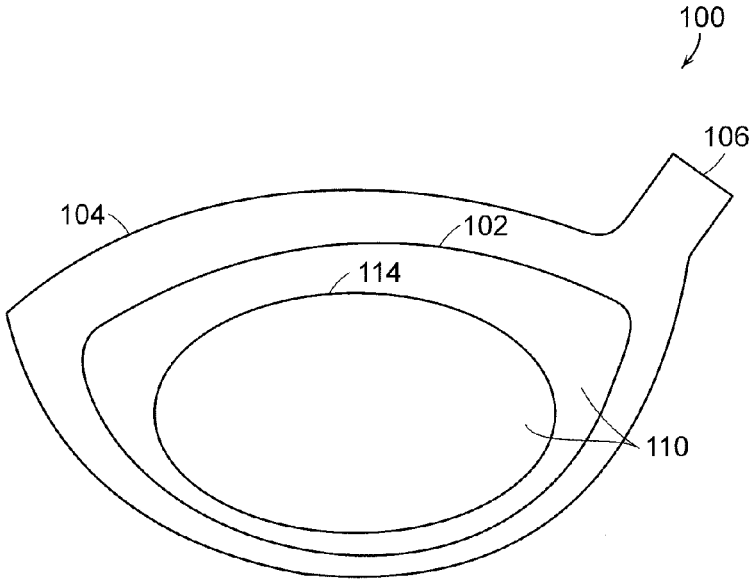
FIG. 12 is a front view of an embodiment of a driver-type club head of the present invention.
Figure 13:
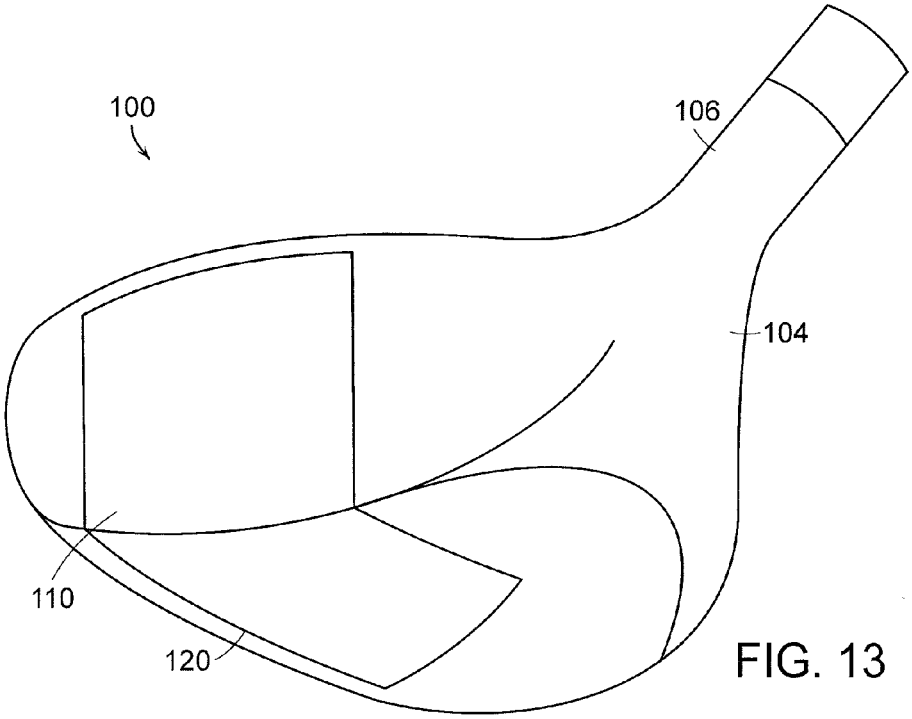
FIG. 13 is a perspective view of another embodiment of a driver-type club head of the present invention.

In yet another embodiment, as shown in FIG. 11, a hard-anodic coating may be infused or impregnated with a polymer 117, preferably a fluorinated polymer such as polytetrafluoroethylene (PTFE), commonly known and available as Teflon® from DuPont, to form low-friction coating 130. Such a process is commercially available as the Sanford Hardlube® process by Duralectra, which is hereby incorporated by reference. The anodized object is immersed in a solution that contains positive PTFE ions and an electrical current is applied. The positive ions become attracted to the object, which acts as an anode, and become infused into the pores of low-friction coating 130. Impregnating the hard-anodic coating with PTFE is especially advantageous when low-friction coating 130 is applied to the faces of golf clubs such as drivers or fairway woods, shown in FIGS. 12-13, where reduced spin is desired, because PTFE has one of the lowest known coefficients of friction.

Figure 10:
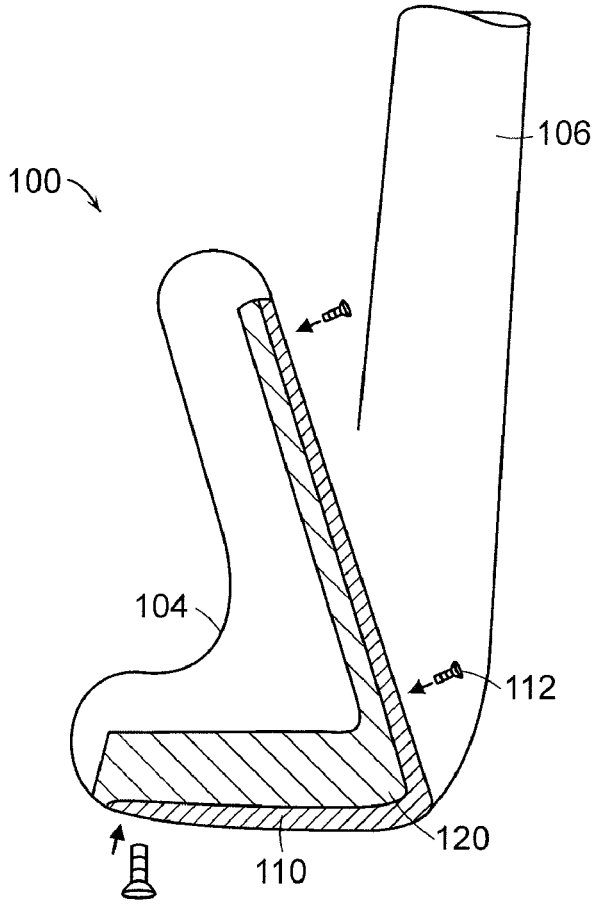
FIG. 10 is a cross-sectional view of another embodiment of a club head of the present invention.

An optional sole plate 108 may be hard-anodized with regular hard-anodic coating 110 or with a low-friction coating 130 impregnated by a polymer such as PTFE, the latter of which provides a further benefit in fairway woods in that the club will have more protection and encounter less friction when sole plate 108 makes contact with the ground, increasing swing speed and club longevity. The hard-anodic sole plate 108 is also advantageous as applicable to drivers, especially when hitting off a standard plastic driving range mat, due to the reduced friction and extra protection provided by the PTFE-infused coating. This is further applicable to iron-type club heads (as shown in FIG. 9) or putter clubs. As shown in FIG. 10, in an alternative to a separate sole plate 108, a unitary face/sole piece 120 may be provided by the current invention, with said unitary piece 120 preferably being hard-anodized with a low-friction coating 130 infused with PTFE. Unitary piece 120 may act to provide much of the same benefits of the separate inventive face insert and sole plate as seen in previous embodiments, but adds further protection and reduced friction to the lower portion of the club head 100.

Figure 11A:
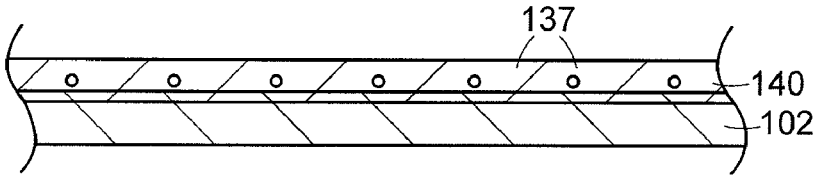
FIG. 11*a* is a cross-sectional view of another infused hard-anodic coating applied to a face insert according to the present invention.

As shown in FIG. 11*a*, in another embodiment, when increased spin is desired, i.e., in iron-type clubs, the hard anodic coating over the face insert 102 may be sealed with a higher-friction polymer material 137 such as an epoxy-based resin, polyurethane, or polyurea to become hard-anodize increased-friction coating 140. This is advantageous for highly skilled golfers who desire increased control of the ball when hitting approach shots into greens, because it will increase the friction between the ball and face insert 102, allowing more control and "workability" for whatever type of shot is desired. The process for infusing the coating with high-friction polymers is similar to the process used for PTFE above. The anodized object is immersed in a solution that contains positive polymer ions and an electrical current is applied. The positive ions become attracted to the object, which acts as an anode, and become infused into the pores of increased-friction coating 140, sealing the structure. In one example, selected iron-type clubs from a set, such as the short irons and wedges, are constructed with increased-friction coating 140 to increase ball spin and control to the short game.

While it is apparent that the illustrative embodiments of the invention disclosed herein fulfill the objectives of the present invention, it is appreciated that numerous modifications and other embodiments may be devised by those skilled in the art. Additionally, feature(s) and/or element(s) from any embodiment may be used singly or in combination with other embodiment(s) and steps or elements from methods in accordance with the present invention can be executed or performed in any suitable order. Therefore, it will be understood that the appended claims are intended to cover all such modifications and embodiments, which would come within the spirit and scope of the present invention.

What is claimed is:

1. A golf club head comprising:

a body, said body portion comprising a first metal;

an interlocking structure formed on at least a section of a front of the body portion adjacent a crown of the club head; a face insert attached to the front of the body portion and secured in the interlocking structure, said face insert comprising a second metal;

wherein the first metal has a greater density than the second metal; wherein the interlocking structure comprises of at least one channel; wherein the at least one channel runs substantially parallel to a top line horizontally and spans from a heel portion of the striking surface to a toe portion of the striking surface, and wherein the face insert is of an unitary piece and engages two or more of the at least one channels.

2. The golf club head of claim 1, wherein the channel comprises a generally rectangular cross section.

3. The golf club head of claim 1, wherein the channel comprises at least one undercut.

4. The golf club head of claim 1, wherein the channel comprises a dove tail shaped cross section.

5. The golf club head of claim 1, wherein the second metal of the face insert substantially fills the channel when the face insert is attached to the body.

6. The golf club head of claim 1, wherein the channel is generally parallel to at least the crown or sole.

7. The golf club head of claim 1, further comprising a plurality of parallel channels substantially parallel to at least one of the top line and the sole of the body.

8. The golf club of claim 1 wherein the interlocking structure further comprising at least one second channel intersecting said at least one channel.

9. A golf club head comprising:

a body portion, said body portion comprising a first metal;

a face insert attached to the front of said body portion, said face insert comprising a second metal; and an interlocking structure;

wherein the first metal is substantially different than the second metal and wherein said face insert is anodized;

wherein the interlocking structure comprises of at least one channel;

wherein the at least one channel runs substantially parallel to a top line horizontally and spans from a heel portion of the striking surface to a toe portion of the striking surface; and wherein the face insert is of an unitary piece and engages two or more of the at least one channels.

10. The club head of claim 9, wherein the first metal has a greater density than the second metal.

11. The club head of claim 9, wherein the second metal comprises aluminum.

12. The club head of claim 11, wherein the second metal has a nominal copper content of less than about 5%, a nominal silicon content of less than about 8%, and a porosity less than about 5%.

13. The club head of claim 9, wherein the second metal comprises titanium.

14. The club head of claim 9, wherein the face insert is hard-anodized.

15. The club head of claim 14, wherein the face insert is attached to the body with epoxy.

16. The club head of claim 14, wherein the face insert is attached to the body with screws.

17. The club head of claim 14, wherein the second metal comprises aluminum having a nominal copper content of less than about 5% and a nominal silicon content of less than about 8%.

18. The club head of claim 9, wherein at least a portion of the anodized face insert is colored.

19. The club head of claim 9, wherein the anodized face insert is infused with an amount of a polymer.

20. The club head of claim 19, wherein the polymer comprises polytetrafluoroethylene.

21. The club head of claim 19, wherein the polymer is selected from the group consisting of polyepoxide, polyurea, or polyurethane.

22. The club head of claim 9, wherein the face insert is attached to the body portion via cold-working or swaging.

23. The club head of claim 9, wherein a section of the body portion is also anodized, said anodized section selected from a group consisting of: a hosel area, a sole plate, a crown, a back region, and the entire body portion.

24. The club head of claim 23, wherein at least the anodized section of the body portion is colored.

25. The club head of claim 23, wherein the anodized section of the body portion is infused with an amount of a polymer.

26. The club head of claim 23, wherein the anodized section of the body portion is a sole plate, and wherein the sole plate and the face insert comprise a unitary piece.

* * * * *